United States Patent [19]

Slattery

[11] Patent Number: 4,693,190

[45] Date of Patent: Sep. 15, 1987

[54] TUFTING MACHINE FOR OVERTUFTING

[75] Inventor: Ian Slattery, Hixson, Tenn.

[73] Assignee: Spencer Wright Industries, Inc., Dalton, Ga.

[21] Appl. No.: 912,316

[22] Filed: Sep. 29, 1986

[51] Int. Cl.[4] ..... D05C 15/08

[52] U.S. Cl. ..... 112/80.3

[58] Field of Search ..... 112/80.3, 80.43, 80.33

[56] References Cited

U.S. PATENT DOCUMENTS 4,548,140 10/1985 Price et al. ..... 112/80.3

*Primary Examiner*—Ronald Feldbaum

*Attorney, Agent, or Firm*—Alan Ruderman

[57] ABSTRACT

A needle plate for a controlled needle tufting machine utilized for overtufting secondary yarn into a backing material having a primary pile previously formed therein. The needle plate has needle plate fingers disposed with the upper support surfaces above the needle plate support surface by an amount substantially equal to the pile height of the primary yarn tufts. As the backing material with the primary tufts is fed over the needle plate it is raised relative to the needle plate as it rides over the finger support surfaces. The hooks of the tufting machine may therefore be raised so that the pile height of the loops of secondary yarn being overtufted may be reduced by an amount substantially equal to that of the pile height of the primary tufts. This results in reducing the required amount of tip shearing of the secondary pile to bring it level with that of the primary pile. Preferably the fingers have a height substantially equal to the pile height of the primary tufts to provide sufficient support for the fabric and prevent interference of the hooks with the primary pile.

9 Claims, 4 Drawing Figures

TUFTING MACHINE FOR OVERTUFTING

BACKGROUND OF THE INVENTION

This invention relates to tufting machines and more particularly to a controlled needle tufting machine for performing overtufting operations.

Controlled needle tufting machines are known which operate to skip stitch in accordance with a program for forming tufted designs in a backing fabric. Basically these machines render selective needles or groups of needles inoperative while the remainder of the needles are operative to pierce the backing fabric upon each stroke of the needle bar. Examples of this type of machine are illustrated in U.S. Pat. Nos. 3,115,856; 3,259,088 and 3,881,432.

Overtufting is a process wherein a previously formed with pile fabric is then tufted to insert additional pile, such additional pile being stitched at predetermined locations in the base material and primary or base pile. Overtufting with yarn of different colors than the primary pile provides desirable and appealing patterning effects in the fabric, especially carpeting.

In the production of carpeting in this manner the base material with the primary pile is fed across the needle plate of the tufting machine with the primary pile disposed on the needle plate fingers and projecting downwardly toward the loopers or hooks which cooperate with the needles carrying the overtuft or secondary yarn. In the prior art the needle plate fingers are at substantially the same level as the top of the needle plate at the location where the fingers project from the needle plate. The backing material within which the primary pile is stitched is thus spaced above the needle plate fingers by an amount substantially equal to the height of the primary pile so that the height of the secondary pile formed about the loopers or hooks is more or less substantially equal to the height of the primary pile plus the distance that the loop seizing edge of the loopers or hooks are below the top of the needle plate fingers. The secondary pile, which of course is also stitched into the backing material, is therefore of a height substantially greater than the primary pile height. Because of this, a substantial amount of secondary pile yarn must be tip sheared after tufting so that the secondary pile and the primary pile will be level. The amount of yarn which is thus sheared is of course wasted. Thus, it is highly desirable to minimize the amount of yarn which must be sheared and thereby reduce the cost of the process.

SUMMARY OF THE INVENTION

Consequently, it is a primary object of the present invention to provide apparatus for reducing the amount of yarn that must be sheared from an overtufted pile fabric.

It is another object of the present invention to provide apparatus for reducing the pile height of the overtufted secondary yarn relative to the primary pile height as the overtufted yarn is being tufted into the primary pile of a tufted fabric.

It is a further object of the present invention to provide in a tufting machine a needle plate having needle plate fingers for supporting a tufted pile fabric so that a minimum amount of a secondary yarn may be overtufted into the fabric thereby reducing the amount of tip shearing required to level the overtufted pile to that of the originally tufted primary pile.

It is a still further object of the present invention to provide in a tufting machine stitching an overtuft secondary yarn into a pile fabric having primary tufts therein a means for permitting the needle plates to be lowered relative to the loopers or hooks while still supporting the backing material on the needle plate fingers so that the overtuft secondary yarn may be formed in the primary tufted fabric with a shorter pile height than heretofore possible, thereby reducing the amount of tip shearing of the secondary pile when leveled to that of the primary pile.

It is yet a still further object of the present invention to provide in a tufting machine controllably overtufting secondary yarn into a backing material having tufts of primary yarn therein, needle plate fingers disposed with the supporting surfaces above the needle plate support surface by an amount substantially equal to the pile height of the primary yarn tufts so that as the backing material with the primary tufts therein is fed to the needles over the needle plate the backing material is disposed on the upper surfaces of the needle plate fingers and the pile height of the loops of the secondary yarn being tufted may be reduced by an amount substantially equal to the pile height of the primary tufts.

Accordingly, the present invention provides a needle plate for a tufting machine of the controlled needle variety wherein selective yarn carrying needles may be inserted into a backing material to overtuft secondary yarn into the backing material which has a base of primary pile previously formed therein, the needle plate having needle plate fingers disposed with the upper support surfaces above the needle plate support surface by an amount substantially equal to the pile height of the primary yarn tufts. As the backing material with the primary tufts therein is fed to the needles over the needle plate the backing material is raised or lifted relatively to the needle plate by the disposition of the upper support surfaces of the needle plate fingers so that the needle plate together with the fingers may be lowered relative to the loopers or hooks thereby effecting a reduction in the pile height of the loops of the secondary yarn being overtufted into the fabric, the reduction preferably being substantially equal to the pile height of the primary pile.

The fingers preferably have a thickness or depth substantially equal to the pile height of the primary tufts and thus the lower edges of the fingers are disposed substantially at the same level as the needle plate surface thereby providing sufficient support for the backing material while maintaining the primary pile away from the loopers or hooks so as not to interfere with loop seizure of the secondary pile yarn.

With this construction the surface of the needle plate can be lowered relative to the loopers or hooks or, to state this conversely, the loopers or hooks may be elevated relative to the backing material without interference of the loopers or hooks with the needle plate fingers. Thus, the pile height of the overtufted secondary yarn may be reduced relative to that in the prior art. Less secondary yarn is thereby required to be tip sheared when the secondary pile is cut to the level of the primary pile height. The amount of the reduction in the height of the loops of secondary yarn is substantially equal to the pile height of the primary yarn so that the savings in yarn for each loop of secondary yarn is substantially twice the pile height of the primary yarn thereby resulting in a substantial savings when one considers the large amount of secondary loops being tufted and the amount of fabric produced.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
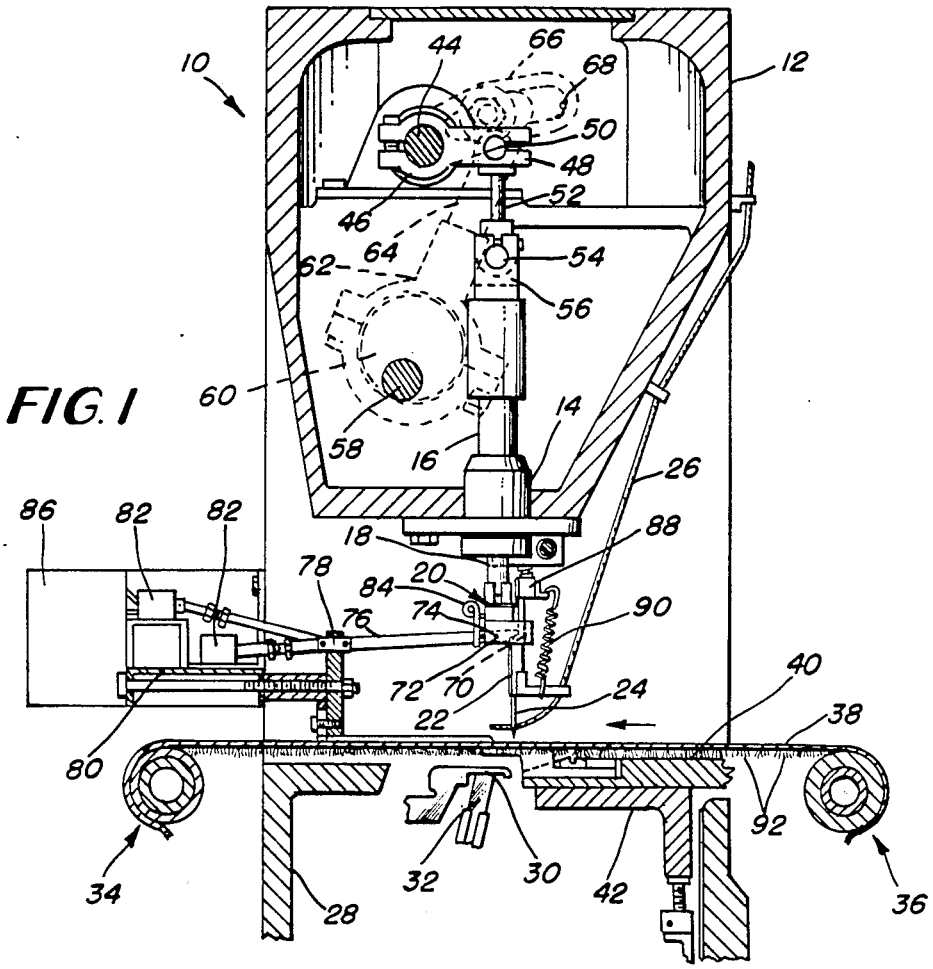
FIG. 1 is a vertical cross sectional view taken substantially through a tufting machine incorporating the features of the present invention.

Referring to the drawings, and more particularly to FIG. 1, the pertinent portions of a tufting machine 10 required for a description of the present invention is disclosed. The machine comprises a head 12 within which is secured a plurality of collars 14, only one of which is illustrated, for supporting respective sleeves 16. Journally disposed for reciprocation within each sleeve 16 is a push rod 18. The lower end of the push rods 18 support a needle bar 20 extending transversely of the tufting machine. Slidably supported for selective coupling to the needle bar are a plurality of needle carriers 22, each of which preferably supports a single needle 24. Yarn 26 may be fed to the needles 24 in any conventional manner.

Below the head in a bed 28 a plurality of loopers or hooks 30 are conventionally mounted for cooperation with a respective needle to seize loops of yarn therefrom, which loops may be cut by knives 32 coacting with the hooks to form cut pile. Feed rollers 34 act to feed the backing material 38 across a needle plate generally indicated at 40 for presentation of the backing to the needles, the needle plate being mounted on an adjustable front bed plate 42.

The push rods 18 may be driven by adjustable drive means similar to that disclosed in U.S. Pat. No. 2,977,905, the drive generally comprising a main shaft 44 rotatably mounted in the head 12 of the machine. Each push rod includes a rocker arm 46 clamped to the main shaft and extending radially therefrom to provide a crank arm 48 conventionally connected by a wrist pin 50 to a connecting link 52. Another wrist pin 54 may connect the lower end of the link 52 to an enlarged upper end 56 of the push rod 18. The rocking motion of the shaft 44 thus effects a reciprocating motion to the push rods and hence to the needle bar 20.

Rocking motion may be conventionally supplied to the main shaft 44 through means including a camshaft 58 parallel to the shaft 44 and driven at one end of the machine by conventional means. A circular eccentric cam 60 is secured on the shaft 88 preferably adjacent each end and a connecting rod 62 is journally mounted on the cam. The upper end 64 of the connecting rod is adjustably connected to a drive lever 66 secured at one end to the main shaft 44, the drive lever 66 having an arcuate slot within which the upper end 64 of the connecting rod is connected. The path of the slot 68 has a center of curvature coinciding with the geometric center of the cam 60 when the cam is at bottom dead center so that the needle stroke may be adjusted without changing the bottom position of the needle stroke. Repositioning of the connection between the upper end 64 of the connecting rod 62 in the slot 68 changes the amplitude of oscillation of the lever 66 and effects a change in amplitude in rocking of the shaft 44.

The tufting machine illustrated is a controlled needle machine in which selective needle carriers 22 may be coupled to the reciprocating needle bar 20. Coupling of a needle carrier 22 to the needle bar thereby results in reciprocation of the respective needle 24 for insertion of a loop of yarn through the backing material for seizure of the loop by the hook 30. To this end the needle bar 20 comprises a block having vertical bores 70 for slidably receiving the respective needle carriers 22, and a plurality of substantially horizontal bores 72 for slidably receiving a latch pin 74 for each needle carrier having a prong at the end thereof. Each latch pin is pivotably connected to one end of a connecting rod 76 operatively connected through a link 78 constrained for slidable movement. A mounting bracket 80 may be secured to the frame of the machine 10 for supporting a pluarlity of solenoids or the like 82, each being operatively connected to a respective link 78 so as to insert or withdraw the respective latch pin 74 to engage or disengage the corresponding needle carrier 22 from the reciprocating needle bar 20. When the solenoid is deactivated a spring 84 urges the prong at the end of the latch pin into driving relationship with the needle bar. Activation and deactivation of the respective solenoids is controlled by a pattern control mechanism 86 of any conventional type. An adjustable needle carrier stop bar is supported above the needle carriers to aid in limiting the upward stroke of the reciprocating needle carriers, one end of a respective spring 90 being fastened to the stop bar and the other end being fastened to a respective needle carrier to urge it upwardly against the stop bar when the respective solenoid is activated to disengage the respective needle carrier from the needle bar.

Figure 4:
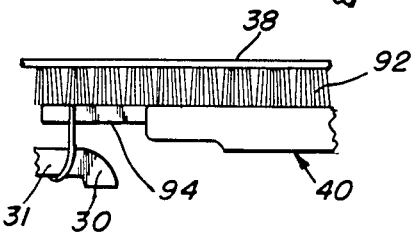
FIG. 4 PRIOR ART
FIG. 4 is a view similar to FIG. 3 but illustrating the prior art.

In the method of overtufting, the backing material 38 has a tufted primary pile fabric 92 formed therein prior to being fed by the roller means 36 to the machine 10 and the yarn 26 is tufted by the needles 24 selectively to form a secondary pile in the fabric, the secondary pile forming a pattern therein as determined by the pattern control 86. Since tufts extend from the lower face of the backing material 38 the primary pile tufts 92 are disposed on and fed over the needle plate 40. Conventionally, as illustrated in FIG. 4, the needle plate fingers 94 are merely wires or sall bars which extend directly outwardly from the needle plate for supporting the fabric as it is fed beneath the needles, the top or support surfaces of the fingers being substantially at the same level as the needle plate support surface. Thus, in the prior art, the primary pile fabric is disposed on the upper surface of the needle plate fingers and the backing 38 is spaced above the finger support surface by an amount substantially equal to that of the pile height of the primary pile 92. The spacing between the loop seizing surface 31 of the hooks and the backing material 38 determines the pile height of the tufts being formed and since a certain amount of clearance is required between the hooks 30 and the fingers 94, the spacing between the backing material 38 and the surface 31 is substantially equal to the thickness of the fingers, the clearance between the fingers and the hooks, the thickness of the blade of the hooks plus the pile height of the primary tufted pile 92. Thus, when the secondary yarn tufts are sheared to the level of the primary yarn tufts, there is a substantial amount of wasted yarn, that being substantially the height of the pile from the surface 31 to the surface of the pile 92.

Figure 2:
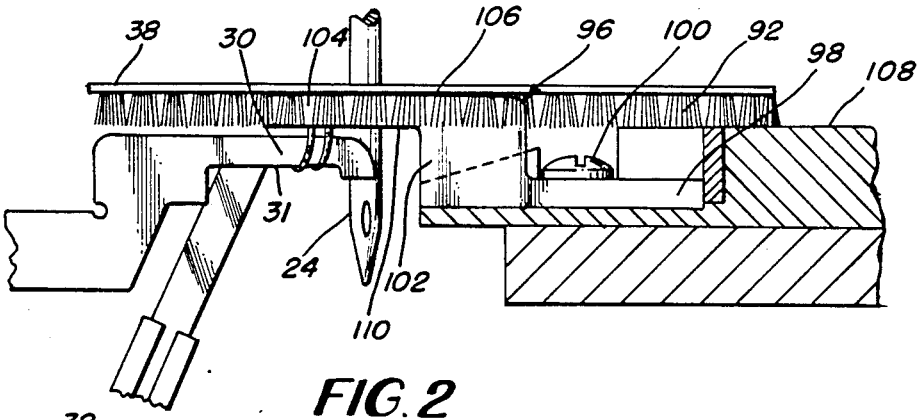
FIG. 2 is an enlarged elevational view of a fragment of the machine illustrated in FIG. 1 depicting the fabric support portion thereof.
Figure 3:
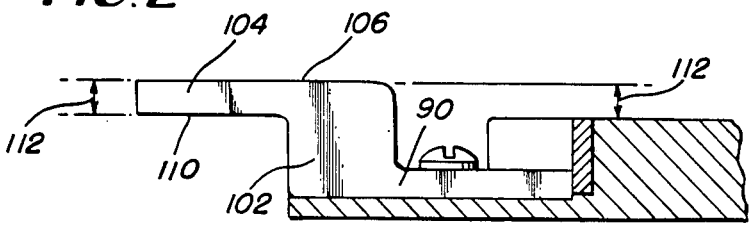
FIG. 3 is a diagrammatic depiction of a needle plate finger in a needle plate illustrating the dimensional aspects of the present invention.

In accordance with the present invention, this waste is reduced by a construction wherein the support surfaces of the needle plate fingers are spaced above the support surface of the needle plate. Accordingly, as illustrated in FIG. 2, the needle plate fingers 96 constructed in accordance with the present invention have a step-up from the needle plate. The fingers 96 have a mounting portion 98 secured to the needle plate in conventional manner, such as by screws 100, such as described in conjunction with FIG. 6 of U.S. Pat. No. 4,548,140, but rather than extending directly out from the needle plate as in the prior art, the fingers 96 have an upstanding step or neck portion 102 from the upper end of which the supporting finger members 104 extend to overlay the hooks 30. The upper support edges 106 of the members 104, which form a support for the fabric, preferably are spaced above the support surface 108 of the needle plate by an amount substantially equal to the pile height of the primary pile 92 and the thickness of the members 104 is such that the needle plate can be lowered with the adjustable front bed plate 42 relative to the hooks 30 to a position where the surfaces 31 of the hooks 30 are substantially above their level in the prior art and the pile height of the secondary pile produced by the yarn 26 is thereby reduced by this amount. With conventional hooks the surface 31 can be raised by an amount substantially equal to the top of the step of the neck 102 relative to the top 108 of the needle plate, i.e., the pile height of the primary pile. Since if the hooks are raised further they may interfere with the primary pile, the thickness of the finger members 104 are constructed to be substantially equal to the pile height of the primary pile, and thus the bottom surfaces 110 of the finger members 104 are substantially at the level of the top surface 108 of the needle plate. With a finger thickness of this amount, the fingers have optimum strength for supporting the fabric. These dimensions are illustrated in FIG. 3 where the reference numerals 112 are dimensions substantially equal to the pile height of the primary pile 92.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims Having thus set forth the nature of the invention, what is claimed herein is:

1. In a tufting machine including means for feeding a pile fabric including a backing material having primary yarn tufts extending therefrom, said primary tuft having a first pile height, and a plurality of stitch forming instrumentalities for forming secondary yarn tufts selectively in said backing to provide an overtuft pile fabric, a needle plate having a support surface over which said pile fabric is fed toward said instrumentalities, said needle plate including a plurality of fingers pojecting therefrom for supporting said pile fabric at the locations of said instrumentalities, each of said fingers comprising a mounting portion fastened to said needle plate, a neck extending from and upstanding from said mounting portion and a finger portion extending from the upper end of said neck in a direction oppositely disposed relative to said mounting portion, said finger portion having an upstanding supporting edge over which said pile fabric is fed from said needle plate, said upper supporting edge being disposed at an elevation above said support surface of said needle plate.

2. In a tufting machine as recited in claim 1 wherein said upper support edge is disposed above said support surface an amount substantially equal to said first pile height.

3. In a tufting machine as recited in claim 2, wherein the height of said finger portion is substantially equal to said first pile height.

4. In a tufting machine having means for feeding a base material including a backing having a first pile extending therefrom, a plurality of yarn carrying needles adapted for reciprocation to penetrate through said base material into cooperation with respective hooks for forming second pile therein, a needle plate for supporting said base material, said needle plate having a support surface on which said first pile is disposed as said base material is fed, said needle plate having a plurality of spaced fingers projecting therefrom for supporting said base material at the location of penetration by said needles, each finger comprising a mounting portion fastened to said needle plate, a neck extending from and upstanding from said mounting portion and a finger portion extending from the upper end of said neck in a direction oppositely disposed relative to said mounting portion, said finger portion having an upper supporting edge over which said pile fabric is fed from said needle plate, said upper supporting edge being disposed at an elevation above said support surface of said needle plate, whereby said hooks may be disposed at an elevation relatively close to said backing to minimize the difference in pile height between said first pile and said second pile and thereby reduce the amount of yarn subsequently sheared to level said second pile with said first pile.

5. In a tufting machine as recited in claim 4, wherein said upper support edge is disposed above said support surface by an amount substantially equal to said first pile height.

6. In a tufting machine as recited in claim 5, wherein the height of said finger portion is substanially equal to said first pile height.

7. A needle plate for use in a tufting machine having means for feeding a base material including a first pile height extending therefrom, and a plurality of stitch forming instrumentalities for forming secondary yarn tufts selectively in said base material, said needle plate comprising a support surface for supporting said base material with said first pile disposed on said support surface as said base material is fed, said needle plate having a plurality of spaced fingers projecting therefrom for supporting the first pile of said base material at the locations of said instrumentalities, said fingers comprising a mounting portion fastened to said needle plate, a neck extending from and upstanding from said mounting portion and a finger portion extending from said upper end of said neck in a direction oppositely disposed relative to said mounting portion, each of said finger portions having an upper supporting edge disposed at an elevation above said support surface of said needle plate.

8. A needle plate as recited in claim 7, wherein said upper supporting edge is disposed above said support surface an amount substantially equal to said first pile height.

9. A needle plate as recited in claim 8, wherein the height of said finger portion is substantially equal to said first pile height.

* * * * *